US012698899B1

(12) United States Patent
Zahn et al.

(10) Patent No.: US 12,698,899 B1
(45) Date of Patent: Aug. 4, 2026

(54) GAS TURBINE ENGINE AND FUEL-AIR MIXER THEREOF

(71) Applicant: GENERAL ELECTRIC COMPANY, Evendale, OH (US)

(72) Inventors: Maximilian Zahn, Munich (DE); Karthikeyan Sampath, Bengaluru (IN); Pradeep Naik, Bengaluru (IN); Pabitra Badhuk, Jhargram (IN); Prithiviraaj Pet T, Madurai (IN); Sibtosh Pal, Mason, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 19/046,842

(22) Filed: Feb. 6, 2025

(51) Int. Cl.

| | |
|---|---|
| ***F23R 3/28*** | (2006.01) |
| ***F23R 3/12*** | (2006.01) |
| ***F23R 3/14*** | (2006.01) |
| ***F23R 3/16*** | (2006.01) |
| ***F23R 3/20*** | (2006.01) |

(52) U.S. Cl.
CPC ..... *F23R 3/286* (2013.01); *F23R 3/12* (2013.01); *F23R 3/14* (2013.01); *F23R 3/16* (2013.01); *F23R 3/20* (2013.01)

(58) Field of Classification Search
None
See application file for complete search history.

(56) References Cited

U.S. PATENT DOCUMENTS

| | | | |
|---|---|---|---|
| 5,235,813 A | 8/1993 | McVey et al. | |
| 6,272,840 B1 * | 8/2001 | Crocker | F23D 11/107 239/404 |
| 6,367,262 B1 | 4/2002 | Mongia et al. | |
| 7,017,329 B2 | 3/2006 | Farhangi et al. | |
| 7,343,745 B2 | 3/2008 | Inoue et al. | |
| 8,205,452 B2 | 6/2012 | Boardman et al. | |
| 8,266,911 B2 | 9/2012 | Evulet et al. | |

(Continued)

FOREIGN PATENT DOCUMENTS

| | | |
|---|---|---|
| CN | 114623467 A | 6/2022 |
| EP | 2362148 A1 | 8/2011 |

(Continued)

OTHER PUBLICATIONS

Extended European Search Report for Application No. 26151178.6 dated Jun. 9, 2026, 8 pages.

*Primary Examiner* — Jason H Duger

(74) *Attorney, Agent, or Firm* — Carter, DeLuca & Farrell, LLP

(57) ABSTRACT

A gas turbine engine including a compressor section, a combustion section, and a turbine section in serial flow arrangement, with the combustion section. The combustion section includes a combustion chamber and a fuel-air mixer fluidly coupled with the combustion chamber. The fuel-air mixer includes an outer wall, a center body disposed radially inward of the outer wall, a first splitter including a first lobed trailing edge, a second splitter including a second lobed trailing edge axially offset from the first lobed trailing edge, a first swirler disposed at least partially between the first splitter and the second splitter; and a set of fuel orifices located at the first lobed trailing edge, the second lobed trailing edge, or the first lobed trailing edge and the second lobed trailing edge.

19 Claims, 10 Drawing Sheets

(56) References Cited

U.S. PATENT DOCUMENTS

| | | | | |
|---|---|---|---|---|
| 8,365,531 | B2 | 2/2013 | Pidcock et al. | |
| 8,528,337 | B2 | 9/2013 | Berry et al. | |
| 8,938,971 | B2 | 1/2015 | Poyyapakkam et al. | |
| 10,408,130 | B2 | 9/2019 | Wysocki et al. | |
| 10,458,655 | B2 * | 10/2019 | Boardman | B05B 7/00 |
| 10,704,786 | B2 | 7/2020 | Laster et al. | |
| 10,865,989 | B2 | 12/2020 | Sadasivuni | |
| 11,022,313 | B2 * | 6/2021 | Boardman | F02C 7/222 |
| 11,054,137 | B2 | 7/2021 | Choi | |
| 11,085,643 | B2 | 8/2021 | Freeman et al. | |
| 11,149,952 | B2 * | 10/2021 | Dai | F23R 3/14 |
| 11,421,885 | B2 | 8/2022 | Patel et al. | |
| 11,754,288 | B2 | 9/2023 | Chandra et al. | |
| 11,815,268 | B2 | 11/2023 | Dai et al. | |
| 2003/0058737 | A1 * | 3/2003 | Berry | B01F 25/4322 366/340 |
| 2005/0097889 | A1 * | 5/2005 | Pilatis | F23D 11/107 60/743 |
| 2012/0131923 | A1 * | 5/2012 | ELKady | F23R 3/286 60/737 |
| 2013/0145765 | A1 * | 6/2013 | Patel | F23R 3/286 60/737 |
| 2014/0109582 | A1 | 4/2014 | Shershnyov et al. | |
| 2017/0350598 | A1 * | 12/2017 | Boardman | F23R 3/14 |
| 2022/0178540 | A1 * | 6/2022 | Chandra | F23R 3/14 |
| 2023/0175435 | A1 * | 6/2023 | Benjamin | B64D 37/30 |
| 2023/0204213 | A1 | 6/2023 | Naik et al. | |
| 2023/0340915 | A1 | 10/2023 | Speak et al. | |
| 2024/0309805 | A1 | 9/2024 | Benjamin et al. | |

FOREIGN PATENT DOCUMENTS

| | | | |
|---|---|---|---|
| EP | 3354984 | B1 | 9/2020 |
| WO | 2013/065624 | A1 | 5/2013 |

* cited by examiner

GAS TURBINE ENGINE AND FUEL-AIR MIXER THEREOF

TECHNICAL FIELD

The present subject matter relates generally to a gas turbine engine having a fuel-air mixer.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

Historically, hydrocarbon fuels are used in the combustor of a turbine engine. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted byproducts, such as nitrogen oxide and nitrogen dioxide (collectively called NOx), carbon monoxide (CO), unburned hydrocarbons (UHC) (e.g., methane and volatile organic compounds that contribute to the formation of atmospheric ozone), and other oxides, including oxides of sulfur (e.g., $SO_2$ and $SO_3$).

To reduce the environmentally unwanted byproducts, other fuels, such as hydrogen, are being explored. Hydrogen or hydrogen mixed with another element has a higher flame temperature than traditional hydrocarbon fuels. That is, hydrogen or a hydrogen mixed fuel typically has a wider flammable range and a faster burning velocity than traditional hydrocarbon-based fuels.

DETAILED DESCRIPTION

Figure 1:
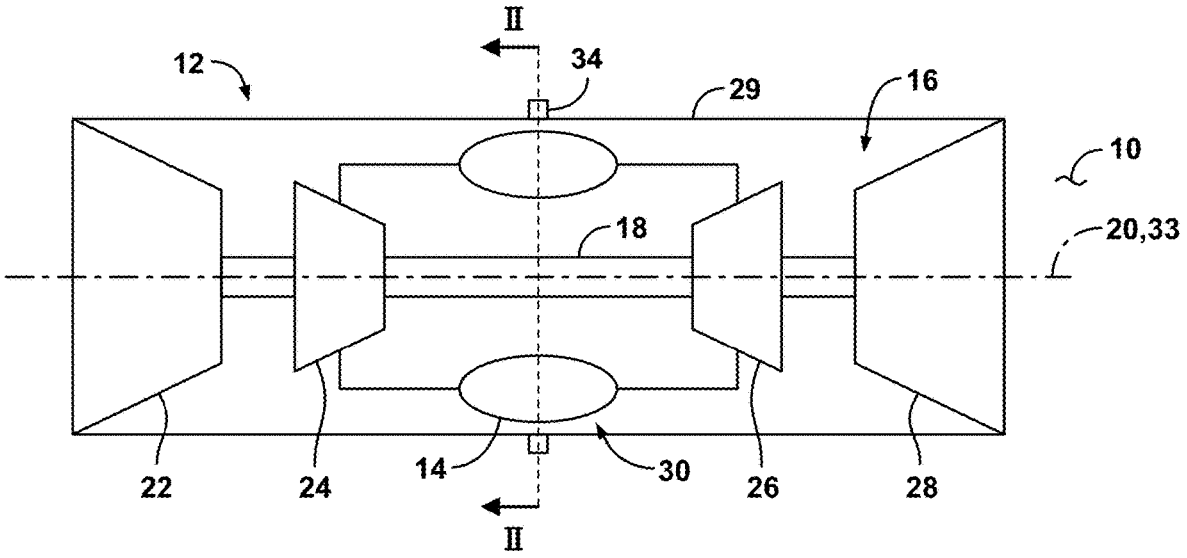
FIG. 1 is a schematic view of a gas turbine engine having a compression section, a combustion section, and a turbine section in accordance with various aspects described herein.

Aspects of the disclosure described herein are directed to a combustor and a fuel nozzle assembly for a combustor. With some aspects, the disclosed combustors and fuel nozzle assemblies can be utilized with gaseous fuel, such as hydrogen. Gaseous fuel, including hydrogen, spreads/disperses at a faster rate than atomized liquid fuel, which can involve less mixing time for the gaseous fuel, fuel mixing tube lengths can be shorter, and the flame from the gaseous fuel may be more likely to spread farther and faster, which can increase the risk of flashback and flameholding (e.g., in a nozzle or mixer), and increase the impact of controlling the flame and limiting flame spread by controlling the dispersion of the gaseous fuel.

Air going through the center body and the convergence of the outer wall of the fuel-air mixer can accelerate air flow in the center of the mixer to push the forward stagnation point and the flame out of the mixer outlet. The first, second, and third swirlers have swirl numbers that gradually transition to a high swirl at the mixer centerline and lower swirl at an outer wall of the mixer. Further, swirler vanes can be angled with respect to the mixer centerline to provide a higher tangential velocity component to improve mixing of fuel and air. A first splitter and a second splitter each have a lobed trailing edge. Fuel can be injected from the lobed trailing edges. The axial offset of the first and second lobed trailing edges creates a cascading effect. The cascading effect causes circular eddies to interact with each other and generate smaller-scale eddies in turn. Ultimately, the process serves as a mechanism for improved mixing.

A third splitter and a third air passage at or near the outer wall can provide a higher axial velocity component to the fluid at the outer wall to avoid flameholding and flashback on the outer wall.

While described with respect to a turbine engine, it should be appreciated that the combustor as described herein can be for any engine having a combustor. It should be appreciated that application of aspects of the disclosure discussed herein are applicable to engines with propeller sections or fan and booster sections along with turbojets and turbo engines as well.

For purposes of illustration, the present disclosure will be described with respect to a turbine engine. It will be understood, however, that aspects of the disclosure described herein are not so limited. A combustor as described herein can be implemented in various engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

With the combustors and fuel nozzle assemblies described herein, hydrogen fuel can be used without the need of diluents. In some embodiments, no diluent is added to the combustion chamber and the fuel is substantially completely diatomic hydrogen without diluent. As used herein, the term "substantially completely," as used to describe the amount of a particular element or molecule (e.g., diatomic hydrogen), refers to at least 99% by mass of the described portion of the element or molecule, such as at least 97.5%, such as at least 95%, such as at least 92.5%, such as at least 90%, such as at least 85%, or such as at least 75% by mass of the described portion of the element or molecule. In some examples, the fuel is entirely (e.g., 100%) hydrogen by mass.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", "third", etc. may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluidly coupled" means that a fluid is capable of making the connection between the areas specified.

The term "swirl number" refers to an integral of the tangential momentum to the axial momentum of the flow of fluid downstream of a respective swirler.

The term "nozzle" has been used in various ways in the context of gas turbine engines. In the instant application, "nozzle" refers to a component having a portion for fluid coupling to a fuel supply and having at least one portion for fluidly coupling with a combustor portion, a combustor liner, a combustion chamber, or combinations thereof.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only the dimensions, positions, order, and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Uses of "and" and "or" are to be construed broadly. For example and without limitation, uses of "and" do not necessarily require all elements or features listed, and uses of "or" are inclusive unless such a construction would be illogical.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and systems. In at least some instances, the approximating language may correspond to the precision of an instrument for measuring the value, or the precision of the methods or machines for constructing or manufacturing the components and systems. For example, the approximating language may refer to being within a 1, 2, 4, 5, 10, 15, or 20 percent margin in either individual values, range(s) of values and endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

"Proximate" as used herein is a descriptor for locating parts described herein. Further, the term "proximate" means nearer or closer to the part recited than the following part. For example, a first aperture proximate a wall, the first aperture located upstream from a second aperture means that the first aperture is closer to the wall than the first aperture is to the second aperture.

Additionally, as used herein, a "controller" can include a component configured or adapted to provide instruction, control, operation, or any form of communication for operable components to effect the operation thereof. A controller can include any known processor, microcontroller, or logic device, including, but not limited to: field programmable gate arrays (FPGA), an application specific integrated circuit (ASIC), a full authority digital engine control (FADEC), a proportional controller (P), a proportional integral controller (PI), a proportional derivative controller (PD), a proportional integral derivative controller (PID controller), proportional resonant controller (PR), a hardware-accelerated logic controller (e.g. for encoding, decoding, transcoding, etc.), the like, or a combination thereof. Non-limiting examples of a controller can be configured or adapted to run, operate, or otherwise execute program code to effect operational or functional outcomes, including carrying out various methods, functionality, processing tasks, calculations, comparisons, sensing or measuring of values, or the like, to enable or achieve the technical operations or operations described herein. The operation or functional outcomes can be based on one or more inputs, stored data values, sensed or measured values, true or false indications, or the like. While "program code" is described, non-limiting examples of operable or executable instruction sets can include routines, programs, objects, components, data structures, algorithms, etc., that have the technical effect of performing particular tasks or implement particular abstract data types. In another non-limiting example, a controller can also include a data storage component accessible by the processor, including memory, whether transient, volatile or non-transient, or non-volatile memory.

Additional non-limiting examples of the memory can include Random Access Memory (RAM), Read-Only Memory (ROM), flash memory, or one or more different types of portable electronic memory, such as discs, DVDs, CD-ROMs, flash drives, universal serial bus (USB) drives, the like, or any suitable combination of these types of memory. In one example, the program code can be stored within the memory in a machine-readable format accessible by the processor. Additionally, the memory can store various data, data types, sensed or measured data values, inputs, generated or processed data, or the like, accessible by the processor in providing instruction, control, or operation to effect a functional or operable outcome, as described herein. In another non-limiting example, a controller can be configured for comparing a first value with a second value, and operating and controlling operations of additional components based on the satisfying of that comparison. For example, when a sensed, measured, or provided value is compared with another value, including a stored or predetermined value, the satisfaction of that comparison can result in actions, functions, or operations controllable by the controller.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor section 12 and turbine section 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled to one another. The turbine section 16 can include an HP turbine 26, and an LP turbine 28 serially fluidly coupled to one another. The drive shaft 18 can operatively couple the LP compressor 22, the HP compressor 24, the HP turbine 26 and the LP turbine 28 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about and enshroud one or more sections of the turbine engine 10. It will be appreciated that the representation of the compressor section 12 is merely schematic and that there can be any number of blades, vanes and stages. Further, it is contemplated that there can be any number of other components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section 16 is merely a schematic representation. Further, it is contemplated that there can be any number of other components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14. The combustion section 14 can include a combustor 30 fluidly coupled to a fuel source 34.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10. A centerline 33 of the combustion section 14 can be concentric with the rotational axis 20.

Figure 2:
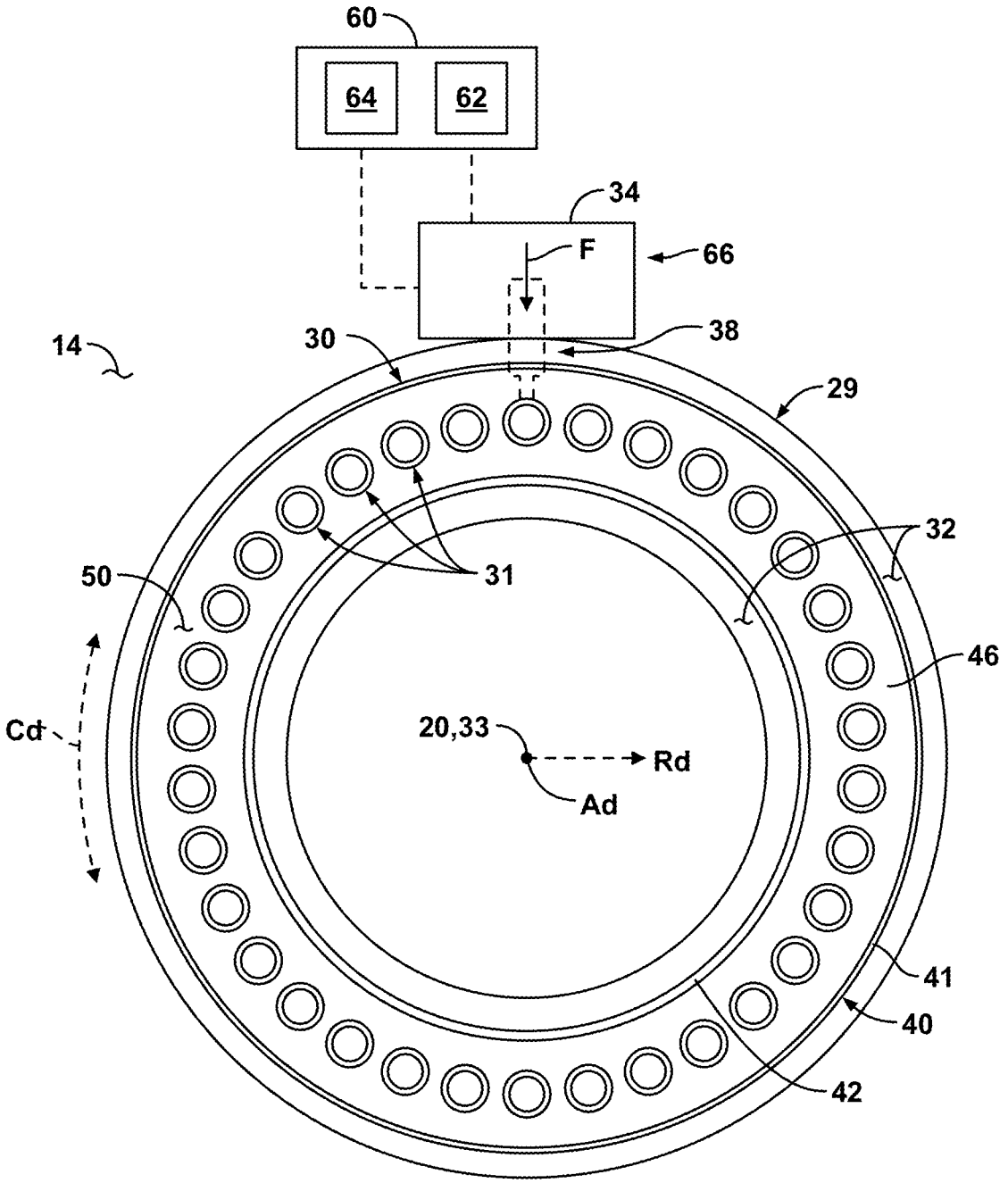
FIG. 2 is a schematic view of the combustion section of FIG. 1 along line II-II in accordance with various aspects described herein.

FIG. 2 depicts a cross-sectional view of the combustion section 14 along line II-II of FIG. 1. The combustion section 14 can include a combustor 30 with an annular arrangement of combustor portions 31 disposed around the centerline or rotational axis 20 of the turbine engine 10 (e.g., circumferentially spaced from each other in an annular configuration) (FIG. 1). The combustor portions 31 can, in some configurations, include or be configured as combustor cups, fuel cups, or nozzle cups. A respective fuel-air mixer 66 can be connected to each combustor portion 31. The combustor 30 can have a can, can-annular, or annular arrangement depending on the type of engine in which the combustor 30 is located. In a non-limiting example, the combustor 30 can have a combination arrangement located with a shroud or casing 29 of the turbine engine 10. The shroud or casing 29 can enshroud or cover at least a portion of the combustion section 14.

The combustor 30 can be at least partially defined by a combustor liner 40. In some examples, the combustor liner 40 can include an outer liner 41 and an inner liner 42 concentric with respect to each other and arranged in an annular fashion about the engine centerline or rotational axis 20. In some examples, the combustor liner 40 can have an annular structure about the combustor 30. In some examples, the combustor liner 40 can include multiple segments or portions collectively forming the combustor liner 40. In some examples, the combustor liner 40 can have an annular structure about the combustor 30. In some examples, the combustor liner 40 can include multiple segments or portions collectively forming the combustor liner 40. In some examples, the combustor liner 40 can include the outer liner 41 radially spaced from the inner liner 42. In some examples, the combustor liner 40 can include a single liner.

The combustor liner 40 can at least partially define a combustion chamber 50 arranged annularly about the rotational axis 20. For example, a dome wall 46 may be substantially perpendicular to the rotational axis 20 and can cooperate with the outer liner 41, the inner liner 42, or both, to at least partially define the combustion chamber 50. A compressed air passage 32 can be defined at least in part by both the combustor liner 40 and the casing 29.

The combustor 30 can include or be fluidly coupled to the fuel source 34 (e.g., an external fuel manifold). The fuel-air mixer 66 can include a fuel nozzle body 38 that fluidly couples the fuel source 34 with the combustion chamber 50. A fuel F can include any suitable fuel, including gaseous fuel, such as hydrogen fuel, in non-limiting examples, which can include 100% $H_2$ (e.g., without a diluent). For example, the fuel-air mixer 66 can be a gaseous fuel-air mixer, such as a gaseous hydrogen fuel-air mixer. The combustor portions 31 can be disposed at a radial distance from the rotational axis 20 that is greater than a radial distance of the inner liner 42 and less than a radial distance of the outer liner 41. A controller 60 can be connected to and at least partially control operation of the fuel source 34, the fuel-air mixer 66, or both. The controller 60 can include a processor 62 and a memory 64. The centerline 33 can define a radial direction Rd, an axial direction Ad, and a circumferential direction Cd.

Figure 3:
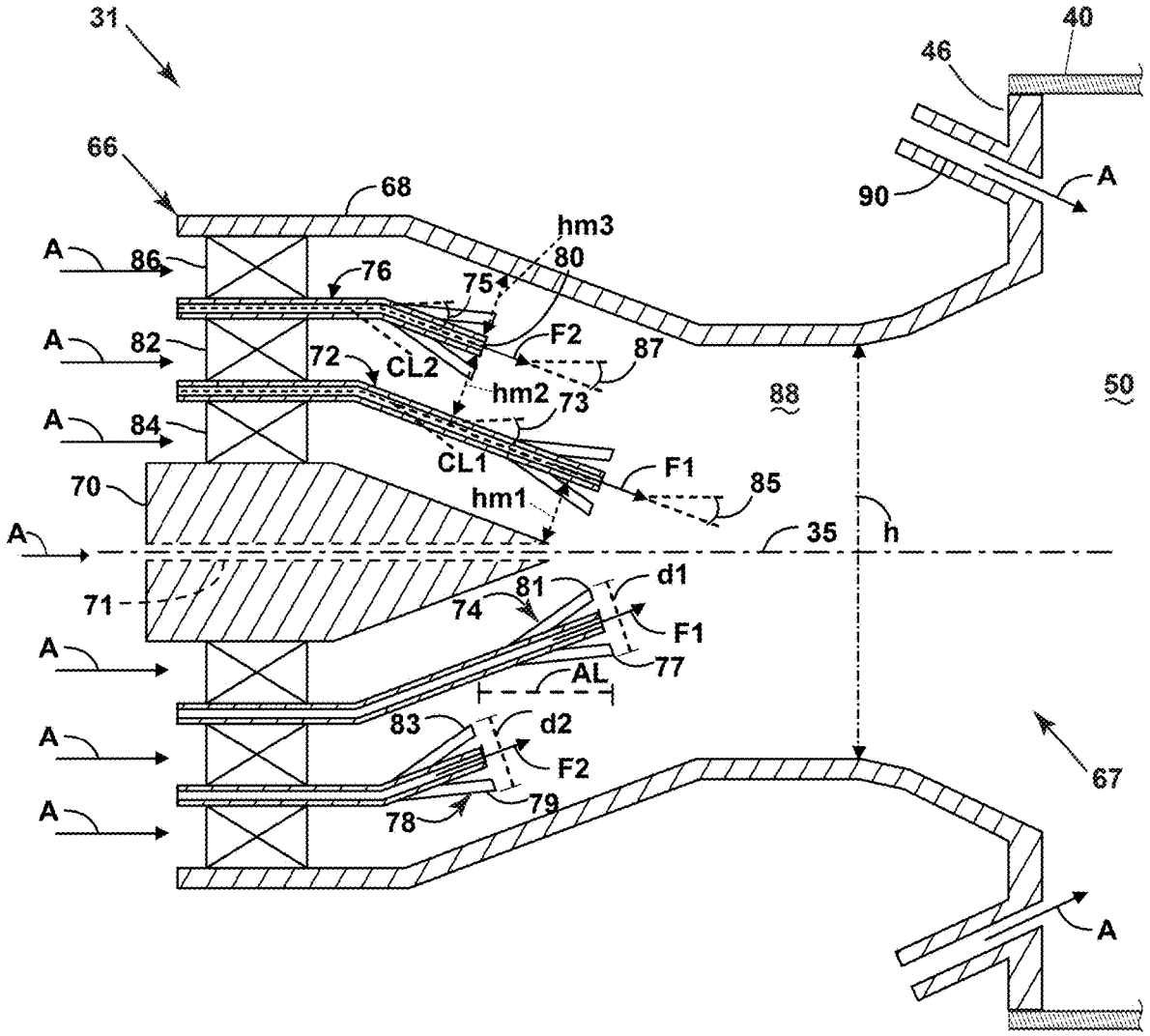
FIG. 3 is an exemplary schematic cross-sectional view illustrating portions of a fuel nozzle assembly coupled to a combustion chamber in accordance with various aspects described herein.

FIG. 3 is a schematic view of an example of one of the combustor portions 31, which can be coupled to or provided, at least in part, by the fuel-air mixer 66. For example, the fuel-air mixer 66 can provide at least a portion of the dome wall 46. The fuel-air mixer 66 can include a mixer centerline 35 that is parallel with and radially offset from the centerline 33 (FIG. 1). The mixer centerline 35 can be colinear with a centerline of the combustor portion 31 to which the fuel-air mixer 66 (FIG. 2) is coupled or incorporated with.

The fuel-air mixer 66 includes an outer wall 68 and a center body 70 that can be located radially inward of the outer wall 68. The center body 70 can, for example, include a conical configuration. The center body 70 can include an air passage 71. The air passage 71 is fluidly coupled with a source of air A, such as the compressor section 12 (FIG. 1). The fuel-air mixer 66 mixes fuel F (FIG. 2) and air A and provides a fuel-air output mixture to the combustion chamber 50. The fuel-air mixer 66 includes an outlet 67 fluidly coupled with the combustion chamber 50.

The fuel-air mixer 66 includes a first splitter 72 disposed at least partially between the outer wall 68 and the center body 70. For example, the first splitter 72 can be annular about the mixer centerline 35. The first splitter 72 includes, for example, a first lobed trailing edge 74. The first lobed trailing edge 74 has a first amplitude d1 measured from a trough 77 of the first lobed trailing edge 74 to a crest 81 of the first lobed trailing edge 74.

The fuel-air mixer 66 includes a second splitter 76 disposed at least partially between the first splitter 72 and the outer wall 68. For example, the second splitter 76 can be annular about the mixer centerline 35. The second splitter 76 includes, for example, a second lobed trailing edge 78. The second lobed trailing edge 78 has a second amplitude d2 measured from a trough 79 of the second lobed trailing edge 78 to a crest 83 of the second lobed trailing edge 78. With some examples, the first amplitude d1 and the second amplitude d2 are in a range of 50% to 150% of a minimum height. The minimum height can be equal to a minimum height hm1 between the center body 70 and the first splitter 72 at a downstream end thereof, a minimum height hm2 between the first splitter 72 and the second splitter 76 at a downstream thereof, or a minimum height hm3 between the second splitter 76 and the outer wall 68 at a downstream end thereof.

In the example shown in FIG. 3, the second lobed trailing edge 78 can be axially offset from the first lobed trailing edge 74. For example, the first lobed trailing edge 74 can be axially downstream of the second lobed trailing edge 78. An axial length AL is measured between the first lobed trailing edge 74 and the second lobed trailing edge 78. The axial length AL between the first and second lobed trailing edges 74, 78 is greater than zero and less than or equal to three times a maximum of a combination of the first amplitude d1 and the second amplitude d2.

The first splitter 72 has a first centerline CL1 (e.g., a first splitter centerline). The second splitter 76 has a second centerline CL2 (e.g., a second splitter centerline). At least portions of the first splitter 72 and its first lobed trailing edge 74 and the second splitter 76 and its second lobed trailing edge 78 can be angled towards the mixer centerline 35 such that the first splitter 72 and the second splitter 76 comprise converging configurations. At least a portion of the first splitter 72 is angled at a first splitter angle 73 with respect to the mixer centerline 35. At least a portion of the second splitter 76 is angled at a second splitter angle 75 with respect to the mixer centerline 35. The first and second splitter angles 73, 75 can be in a range of at least 5 degrees to less than or equal to 60 degrees with respect to the mixer centerline 35. The first splitter angle 73 can be different than the second splitter angle 75. The first lobed trailing edge 74 has a first lobe angle 85. The first lobe angle 85 can be in a range of −45 degrees to 45 degrees with respect to the first centerline CL1. The second lobed trailing edge 78 has a second lobe angle 87. The second lobe angle 87 can be in a range of −45 degrees to 45 degrees with respect to the second centerline CL2. The first lobe angle 85 and the second lobe angle 87 can vary circumferentially (e.g., with alternating lobes angled inward and outward). The first lobe angle 85 can be different from the second lobe angle 87.

A set of fuel orifices 80 are located at the first lobed trailing edge 74, the second lobed trailing edge 78, or the first lobed trailing edge 74 and the second lobed trailing edge 78. The set of fuel orifices 80 are fluidly coupled to the fuel source 34 (FIG. 2). For example, the set of fuel orifices 80 are configured for fuel comprising hydrogen. In the example shown in FIG. 3, the set of fuel orifices 80 are directed radially inward. Directing fuel F radially inward can facilitate mixing of fuel F with air A having increased turbulence downstream of the first splitter 72 and the second splitter 76 near the mixer centerline 35, which can reduce NOx emissions.

The fuel-air mixer 66 can include a first swirler 82 disposed at least partially between the first splitter 72 and the second splitter 76 parallel to the mixer centerline 35. The first swirler 82 includes a first swirl number. A second swirler 84 can be disposed at least partially between the first splitter 72 and the center body 70 parallel to the mixer centerline 35. The second swirler 84 has a second swirl number. Further, a third swirler 86 can be disposed at least partially between the second splitter 76 and the outer wall 68 parallel to the mixer centerline 35. The third swirler 86 has a third swirl number. In some examples, the first swirl number is greater than the second swirl number and the third swirl number. The first swirler 82, which can be positioned radially between the second swirler 84 and the third swirler 86, can include a higher swirl number, which can increase turbulence to facilitate mixing of fuel F and air A. Providing the radially inner and radially outer swirlers, the second and third swirlers 84, 86, respectively, with lower swirl numbers can increase axial velocity to limit flashback and flameholding. In some examples, the fuel-air mixer 66 includes just the first swirler 82 or no swirlers.

The fuel-air mixer 66 includes a premixing chamber 88 defined, at least in part, by the outer wall 68. The outer wall 68 can converge radially inward as the outer wall 68 extends aft toward the combustion chamber 50 defining a converging section, which can increase the velocity of fluid, such as mixtures of fuel F and air A, in the premixing chamber 88. Increasing fluid velocity in the premixing chamber 88, such as near the outer wall 68, can reduce flashback and flameholding. The premixing chamber 88 has a chamber height h. The chamber height h is the diameter of the outer wall 68 at an inner surface of the outer wall 68. A ratio of an axial length of the converging section of the premixing chamber 88 to an axial length of the premixing chamber 88 downstream of the converging section can be in a range of 1:1 to 1:2.

A set of flame shaping passages 90 can be included in at least one of the fuel-air mixer 66 or the dome wall 46. For example, the set of flame shaping passages 90 can be circumferentially arranged and distributed evenly about the mixer centerline 35, can comprise an annular passage, or a combination thereof. In the example shown in FIG. 3 the set of flame shaping passages 90 are angled to emit air A toward the mixer centerline 35.

During operation, air A is supplied to the fuel-air mixer 66, such as from the compressor section 12 (FIG. 1). Air A can be swirled by the first swirler 82 and has a high turbulence directed towards the mixer centerline 35. Swirled air A from the third swirler 86, if provided, has a high axial velocity close to outer wall 68 to avoid flashback as the swirled air is injected into the premixing chamber 88. An axial flow of air A can be injected through the air passage 71 of the center body 70. The axial airflow A can be used to control a stagnation point of a recirculating swirl flow.

Fuel F supplied to the first splitter 72 and the second splitter 76 can be injected from the set of fuel orifices 80. For example, a first fuel flow F1 can be injected from the first lobed trailing edge 74, a second fuel F2 can be injected from the second lobed trailing edge 78, or a combination thereof. The first and second lobed trailing edges 74, 78 generate an air flow field of high vorticity. Meaning, the first fuel flow F1 and the second fuel flow F2 can be injected into and mixed with the swirled air A from the first, second, and third swirlers 82, 84, 86. A benefit of the first lobed trailing edge 74 being axially offset from the second lobed trailing edge 78 is that the first lobed trailing edge 74 and the second lobed trailing edge 78 can create a cascading effect. For example, the first and second lobed trailing edges 74, 78 generate swirling, circular eddies in the swirled air. The circular eddies interact with each other and generate smaller-scale eddies in turn. Ultimately, in combination with the first fuel flow F1 and second fuel flow F2, the configuration facilitates mixing of fuel F and air A.

Figure 4:
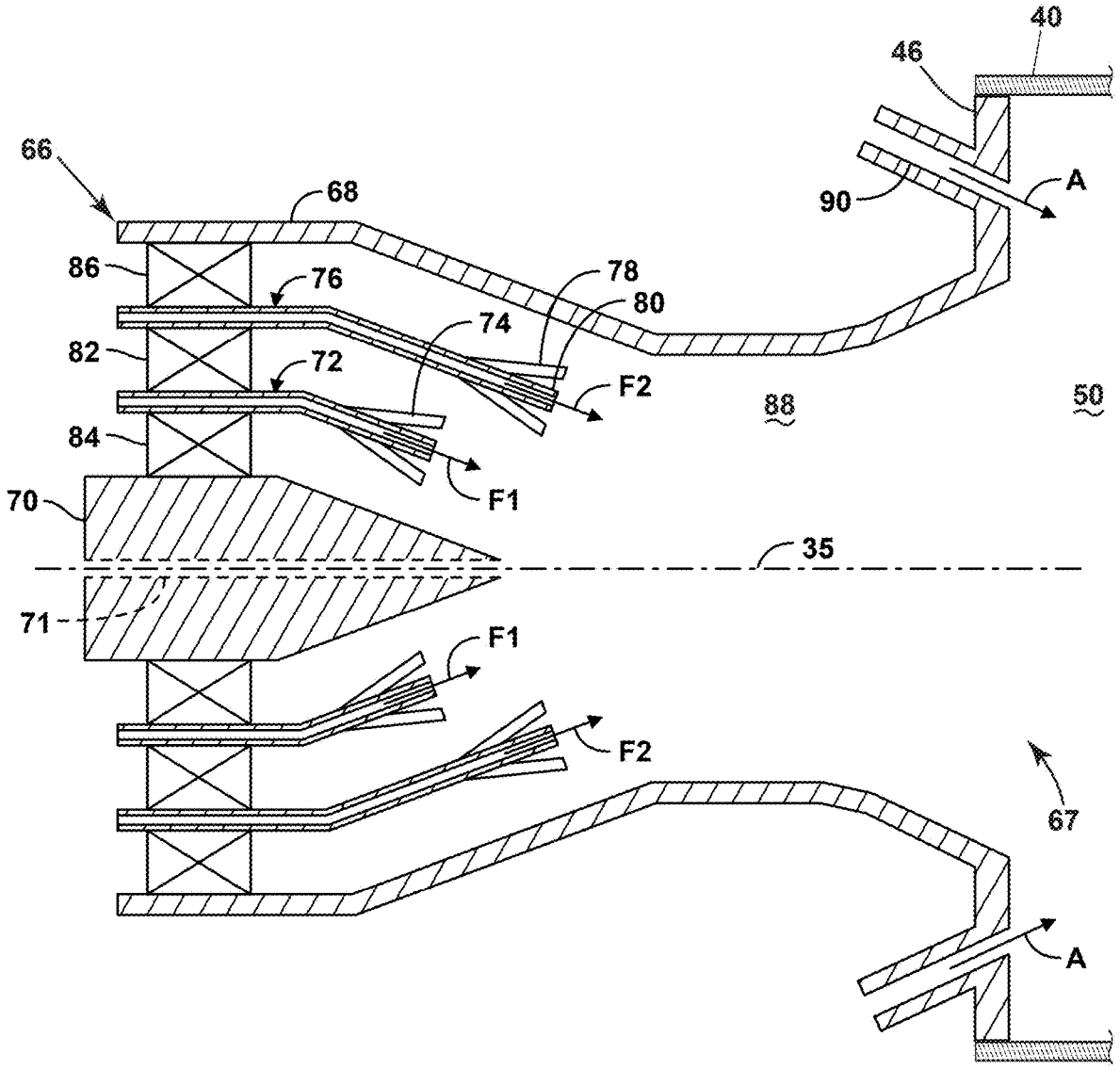
FIG. 4 is an exemplary schematic cross-sectional view illustrating portions of a fuel nozzle assembly coupled to a combustion chamber in accordance with various aspects described herein.

Referring to FIG. 4, the exemplary fuel-air mixer 66 is illustrated with the first lobed trailing edge 74 axially upstream of the second lobed trailing edge 78. At least a portion of the first splitter 72 and the second splitter 76 are angled toward the mixer centerline 35, respectively, by the first splitter angle 73 and second splitter angle 75 (FIG. 3).

Figure 5:
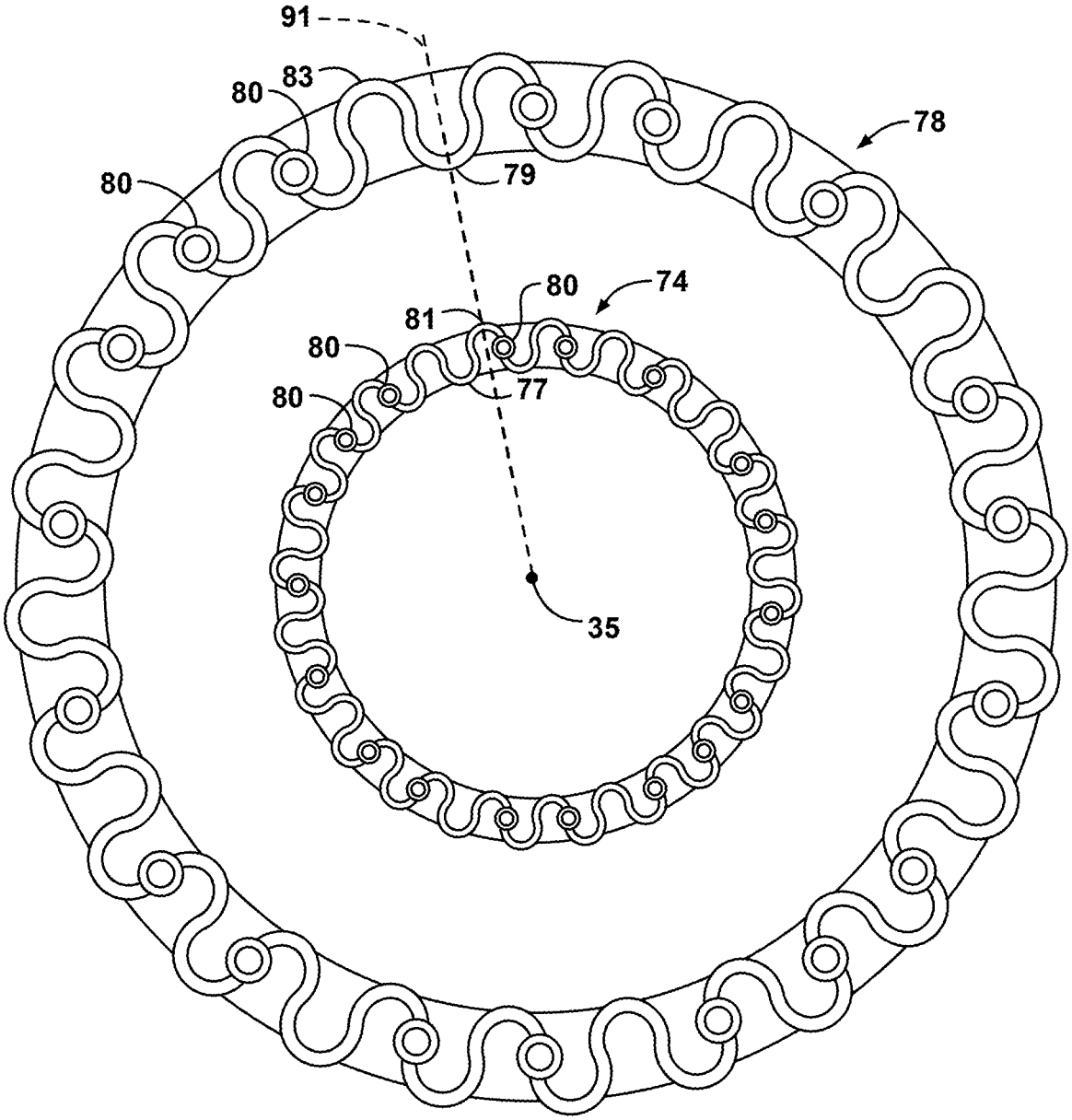
FIG. 5 is a schematic view illustrating a first lobed trailing edge and a second lobed trailing edge in accordance with various aspects described herein.

Referring to FIG. 5, a schematic view from aft of an example of the first lobed trailing edge 74 and the second lobed trailing edge 78. The first lobed trailing edge 74, the second lobed trailing edge 78, or the first lobed trailing edge 74 and the second lobed trailing edge 78 can be lobed shaped, scalloped-lobed shaped, chevron shaped, or a combination thereof. The set of fuel orifices 80 can be arranged at or between the crests 81, 83 and the troughs 77, 79 of the first and second lobed trailing edges 74, 78. Alternatively, the set of fuel orifices 80 can be arranged at or between the crests 81, 83 and troughs 77, 79 of one of the first lobed trailing edge 74 or second lobed trailing edge 78.

The crests 81 of first lobed trailing edge 74 can be circumferentially offset from the crests 83 of the second lobed trailing edge 78. In the example shown in the FIG. 5, the troughs 77 of the first lobed trailing edge 74 are circumferentially aligned with the crests 83 of the second lobed trailing edge 78. The circumferentially offset first and second lobed trailing edges 74, 78 increases mixing in the premixing chamber 88 (FIG. 3). In the non-limiting example shown, the first lobed trailing edge 74 and second lobed trailing edge 78 are straight lobed trailing edges with the crests 81, 83 and troughs 77, 79 aligned with the radial direction relative to the mixer centerline 35. For example, the second lobed trailing edge 78 includes a first trough centerline 91 which extends radially from the mixer centerline 35.

Figure 6A:
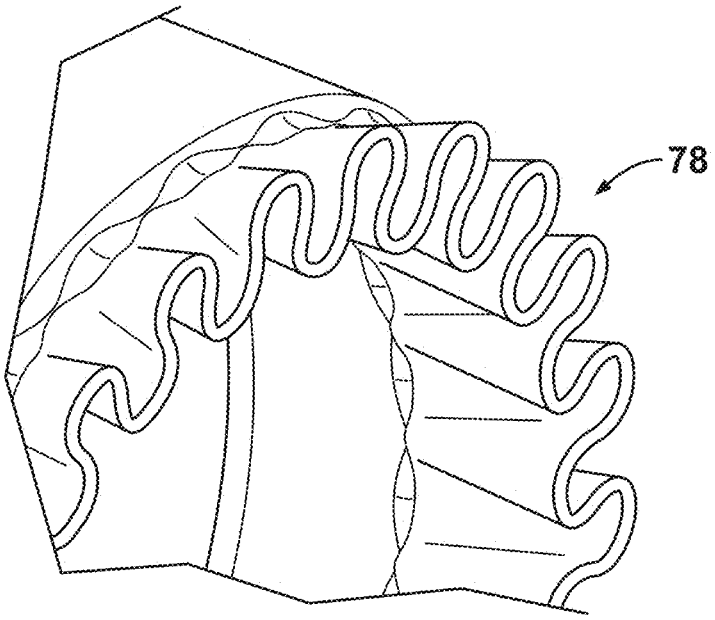
FIG. 6A is a schematic perspective view of the second lobed trailing edge in accordance with various aspects described herein.

In the example shown in FIG. 6A, the second lobed trailing edge 78 is illustrated as an axially straight lobed trailing edge. In some examples the first lobed trailing edge 74 (FIG. 5), the second lobed trailing edge 78, or the first lobed trailing edge 74 and the second lobed trailing edge 78 can be axially straight lobed trailing edges.

Figure 6B:
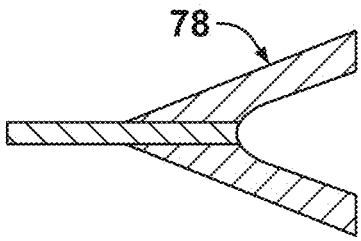
FIG. 6B is a schematic cross-sectional side view of the second lobed trailing edge in accordance with various aspects described herein.

In some examples the first lobed trailing edge 74 (FIG. 5), the second lobed trailing edge 78, or the first lobed trailing edge 74 and the second lobed trailing edge 78 can be scalloped. As shown in FIG. 6B, the second lobed trailing edge 78 is a scalloped trailing edge.

Figure 6C:
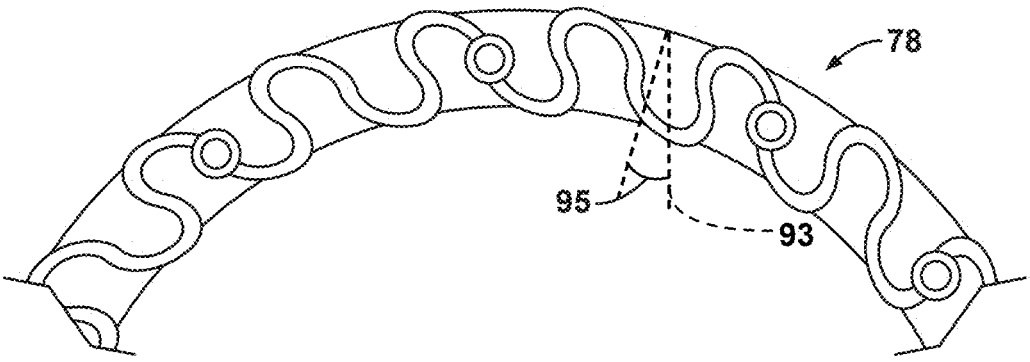
FIG. 6C is a schematic view of the second lobed trailing edge, viewed from aft, in accordance with various aspects described herein.

In another example shown in FIG. 6C, the first lobed trailing edge 74 (FIG. 5), the second lobed trailing edge 78, or the first lobed trailing edge 74 and the second lobed trailing edge 78 can be angled lobed trailing edges. In the non-limiting example shown, the second lobed trailing edge 78 includes a second trough centerline 93 that is angled relative to the radial direction by an angle 95. In some examples, the first lobed trailing edge 74 (FIG. 5), the second lobed trailed edge 78, or both, can include a combination of straight and angled configurations shown in FIGS. 5 and 6C, respectively.

Figure 7:
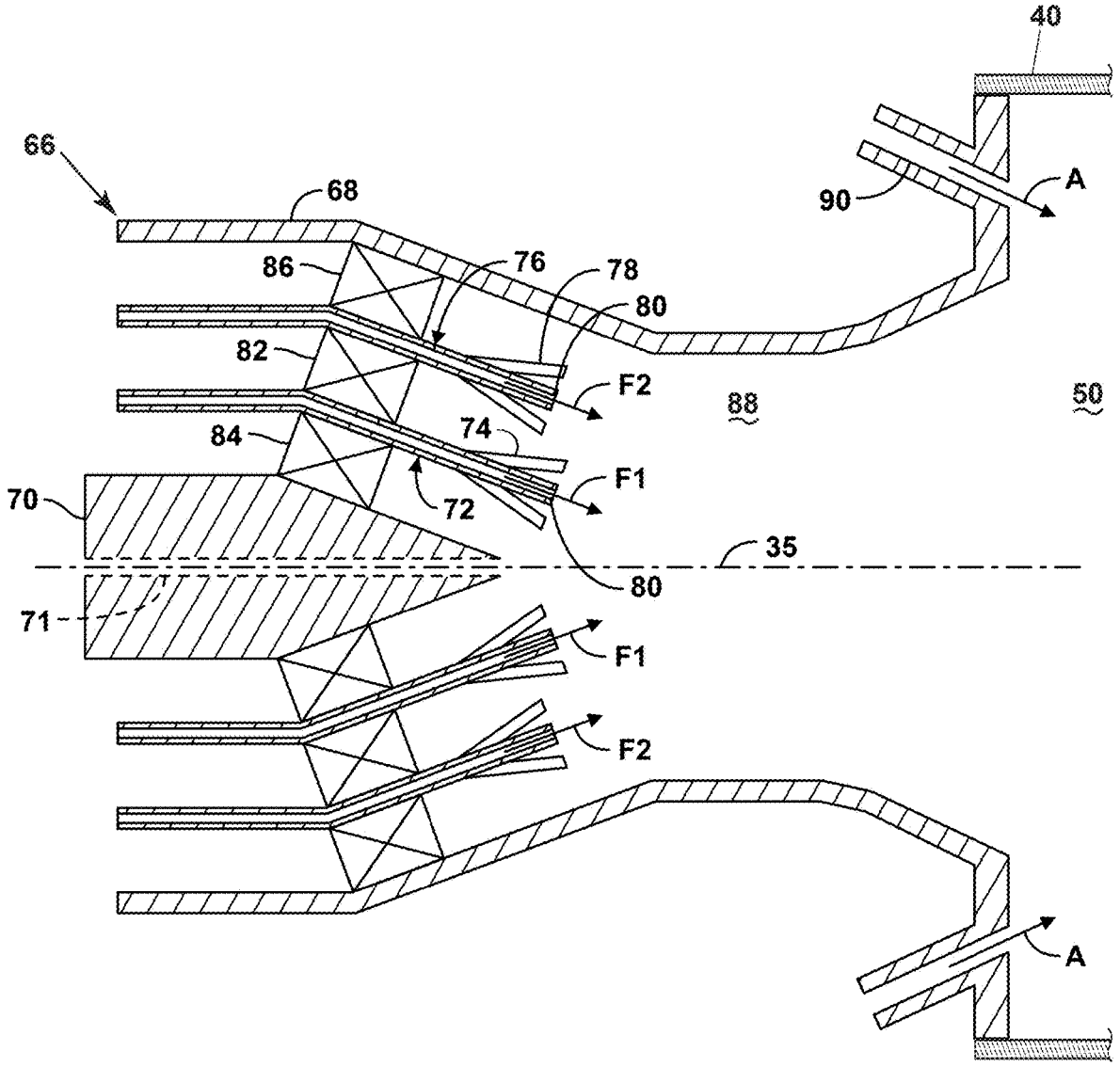
FIG. 7 is an exemplary schematic cross-sectional view illustrating portions of a fuel nozzle assembly coupled to a combustion chamber in accordance with various aspects described herein.

In the example shown in FIG. 7, the first, second, and third swirlers 82, 84, 86 are arranged at an angle with respect to the mixer centerline 35. For example, the first, second, and third swirlers 82, 84, 86 can be angled inward toward the mixer centerline 35. Angling the first, second, and third swirlers 82, 84, 86 can introduce or increase a tangential velocity of air flowing through the first, second, and third swirlers 82, 84, 86. Increasing the tangential velocity of air can facilitate mixing of air with fuel F (FIG. 3), which can decrease NOx emissions. Alternatively, the first, second, or third swirlers 82, 84, 86 can be a combination of angled swirlers and axial swirlers. For example, the first swirler 82 can be an axial swirler (e.g., parallel with respect to the mixer centerline 35) and the second and third swirlers 84 and 86 can be angled towards the mixer centerline 35. The angle of the first, second, and third swirlers 82, 84, 86 can vary. The angle can be the same for each of the first, second, and third swirlers 82, 84, 86 or can be different for at least one of the first, second, and third swirlers 82, 84, 86. While the fuel-air mixer 66 is shown with the first, second, and third swirlers 82, 84, 86, other configurations can be utilized. For example, the fuel-air mixer 66 can include the first swirler 82 between the first and second splitters 72, 76, and the second and third swirlers 82, 86 can be omitted.

Figure 8:
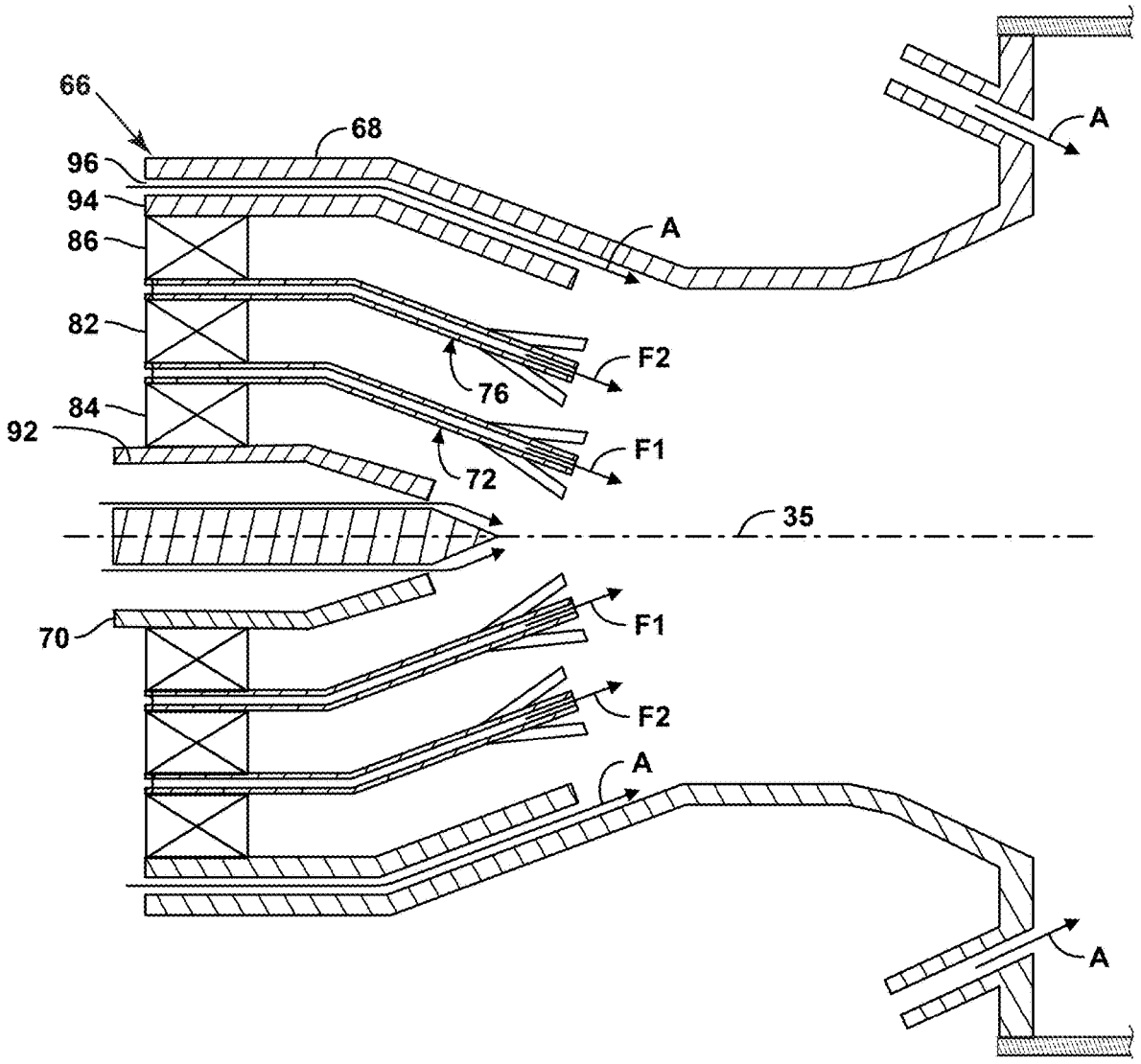
FIG. 8 is an exemplary schematic cross-sectional view illustrating portions of a fuel nozzle assembly coupled to a combustion chamber in accordance with various aspects described herein.

Referring to FIG. 8, the center body 70 can include a second air passage 92, such as instead of the air passage 71 (FIG. 7). The second air passage 92 is illustrated as annular about the mixer centerline 35. Alternatively, the second air passage 92 can include a plurality of air passages circumferentially and evenly arranged about the mixer centerline 35.

The first splitter 72 can disposed at least partially between the outer wall 68 and the center body 70. The second splitter 76 can be disposed at least partially between the first splitter 72 and a third splitter 94. The third splitter 94 can be disposed at least partially between the second splitter 76 and the outer wall 68. The third splitter 94 is illustrated without a lobed trailing edge. However, the third splitter 94 can include a third lobed trailing edge. The third splitter 94 at least partially defines a third air passage 96. The third air passage 96 is defined by the third splitter 94 and the outer wall 68. The third air passage 96 can be annular about the mixer centerline 35, however that need not be the case. The third splitter 94 defines the third air passage 96 such that air A can flow through the third air passage 96 parallel to the mixer centerline 35. As air A travels downstream, the third splitter 94 is angled towards the mixer centerline 35, directing the air radially inward, at least to some degree, but still along the outer wall 68. Air A flows along the outer wall 68, which creates a higher near-wall velocity to reduce flashback and flameholding. Air A injected at the center body 70 by the second air passage 92 controls the stagnation point of the recirculating swirl flow. While the fuel-air mixer 66 is shown with the first, second, and third splitters 72, 76, 94, and the first, second, and third swirlers 82, 84, 86, other configurations can be utilized. For example, the second splitter 76 and the third swirler 86 can be omitted, and the first swirler 82 can extend from the first splitter 72 to the third splitter 94.

Figure 9:
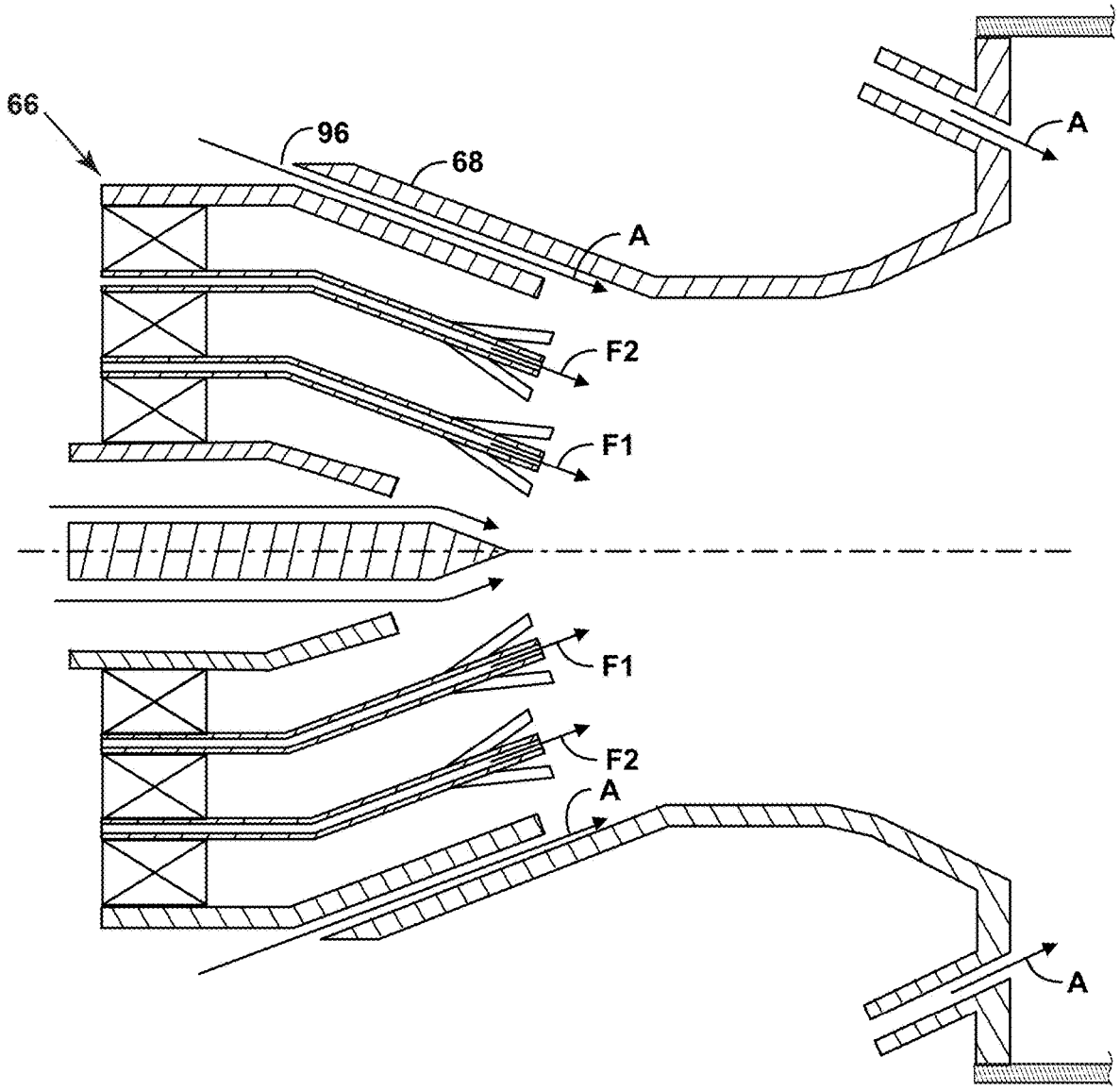
FIG. 9 is an exemplary schematic cross-sectional view illustrating portions of a fuel nozzle assembly coupled to a combustion chamber in accordance with various aspects described herein.

As shown in FIG. 9, in some configurations, the third air passage 96 can be provided, at least in part by the outer wall 68, such as instead of by the third splitter 94 (FIG. 8).

Figure 10:
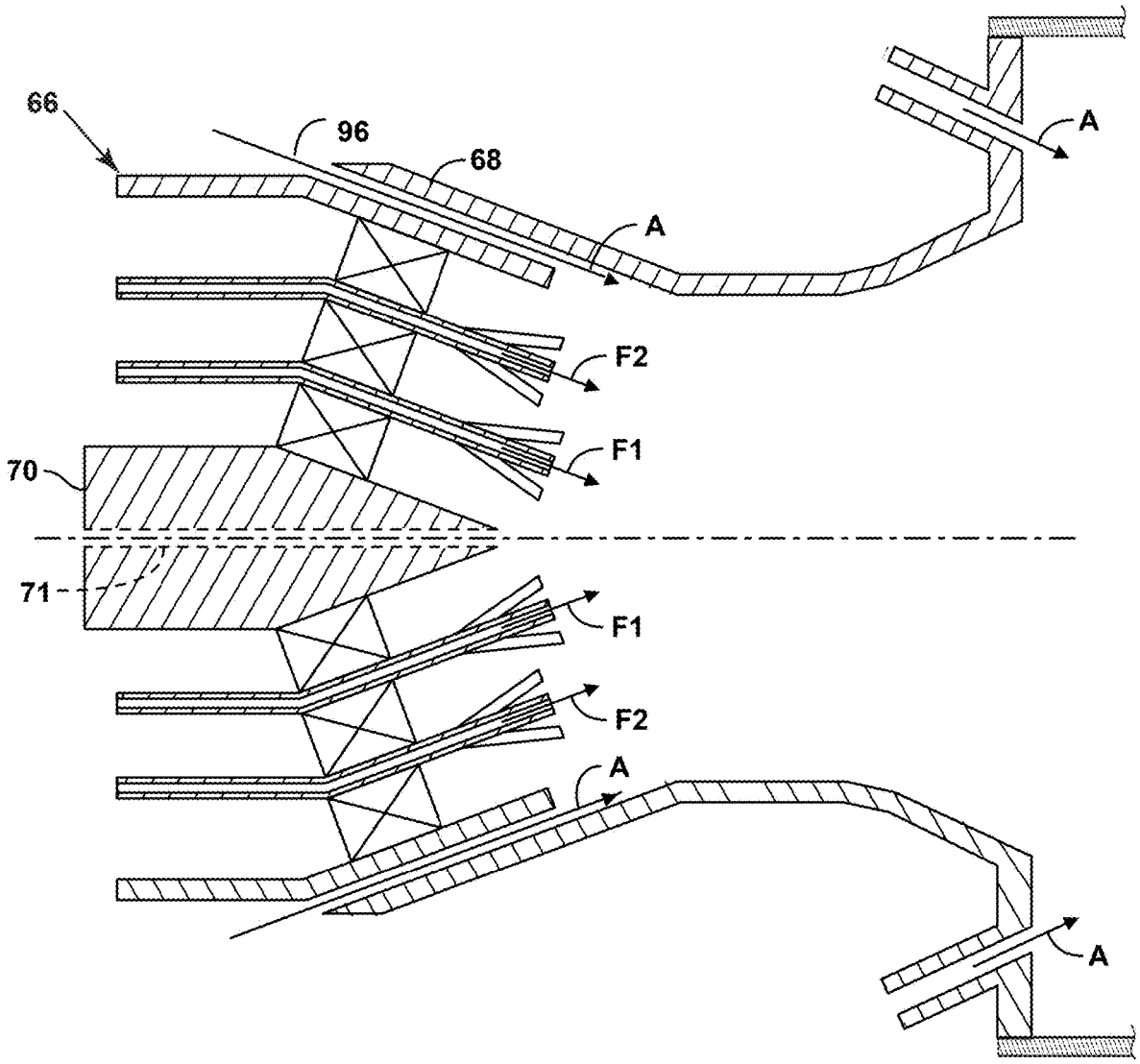
FIG. 10 is an exemplary schematic cross-sectional view illustrating portions of a fuel nozzle assembly coupled to a combustion chamber in accordance with various aspects described herein.

As shown in FIG. 10, the third air passage 96 can be provided, at least in part by the outer wall 68, and the center body 70 can include the air passage 71, such as instead of the second air passage 92 (FIG. 9).

While several examples are provided with more than one splitter, such as the first, second, and third splitters 72, 76, 94, the fuel-air mixer 66 can include a single splitter such as the first splitter 72. Also, while several examples are illustrated with three swirlers, such as the first, second, and third swirlers 82, 84, 86, the fuel-air mixer 66 can include other numbers of swirlers, such as two swirlers, a single swirler, or no swirlers. For example, the fuel-air mixer 66 can include a single splitter (e.g., the first splitter 72), one swirler (e.g., the first swirler 82) radially outward of the single splitter, and one swirler (e.g., the second swirler 84) radially inward of the single splitter.

To the extent not already described, the different features and structures of the various embodiments can be used in combination, or in substitution with each other as desired. That one feature is not illustrated in all of the embodiments is not meant to be construed that it cannot be so illustrated but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A gas turbine engine, comprising: a compressor section, a combustion section, and a turbine section in serial flow arrangement, with the combustion section comprising: a combustor liner that at least partially defines a combustion chamber; and a fuel-air mixer fluidly coupled with the combustion chamber, the fuel-air mixer comprising: an outer wall; a center body disposed radially inward of the outer wall; a first splitter disposed at least partially between the outer wall and the center body, and including a first lobed trailing edge; a second splitter disposed at least partially between the first splitter and the outer wall, and including a second lobed trailing edge axially offset from the first lobed trailing edge; a first swirler disposed at least partially between the first splitter and the second splitter; and a set of fuel orifices located at the first lobed trailing edge, the second lobed trailing edge, or the first lobed trailing edge and the second lobed trailing edge.

The gas turbine engine of any preceding clause, wherein the first lobed trailing edge and the second lobed trailing edge are angled with respect to the first splitter centerline and the second splitter centerline.

The gas turbine engine of any preceding clause, wherein the first lobed trailing edge has a first lobe angle, wherein the first lobe angle is in a range of −45 degrees to 45 degrees with respect to a first splitter centerline.

The gas turbine engine of any preceding clause, wherein the second lobed trailing edge has a second lobe angle, wherein the second lobe angle is in a range of −45 degrees to 45 degrees with respect to a second splitter centerline.

The gas turbine engine of any preceding clause, wherein the first lobe angle is different from the second lobe angle.

The gas turbine engine of any preceding clause, wherein a crest of the first lobed trailing edge is circumferentially offset from a crest of the second lobed trailing edge.

The gas turbine engine of any preceding clause, wherein the first lobed trailing edge is axially downstream of the second lobed trailing edge.

The gas turbine engine of any preceding clause, wherein the first lobed trailing edge is axially upstream of the second lobed trailing edge.

The gas turbine engine of any preceding clause, wherein the set of fuel orifices are configured for fuel comprising hydrogen.

The gas turbine engine of any preceding clause, wherein the fuel-air mixer further comprises a second swirler disposed at least partially between the first splitter and the center body, and a third swirler disposed at least partially between the second splitter and the outer wall.

The gas turbine engine of any preceding clause, wherein the first swirler has a first swirl number, the second swirler has a second swirl number, and wherein the first swirl number is greater than the second swirl number.

The gas turbine engine of any preceding clause, wherein the third swirler has a third swirl number, and wherein the second swirl number and third swirl number are lower than the first swirl number.

The gas turbine engine of any preceding clause, wherein the center body includes an air passage.

The gas turbine engine of any preceding clause, wherein the first lobed trailing edge includes a trough and a crest, a first amplitude measured from the trough to the crest of the first lobed trailing edge, and the second lobed trailing has a second amplitude measured from the trough to the crest of the second lobed trailing edge.

The gas turbine engine of any preceding clause wherein an axial length of an axial offset of the first lobed trailing edge and second lobed trailing edge is measured from the first lobed trailing edge to the second lobed trailing edge and the axial length is greater than zero and less than equal to three times a maximum of a first amplitude and a second amplitude.

The gas turbine engine of any preceding clause, wherein the axial offset of the first lobed trailing edge and second lobed trailing edge is configured to create a cascading effect to increase mixing of fuel and air.

The gas turbine engine of any preceding clause, wherein a set of flame shaping passages are angled toward the mixer centerline.

The gas turbine engine of any preceding clause, wherein the center body includes an air passage, wherein the air passage extends annularly about a mixer centerline.

The gas turbine engine of any preceding clause, wherein the fuel-air mixer includes a third splitter disposed at least partially between the second splitter and the outer wall.

The gas turbine engine of any preceding clause, wherein the third splitter at least partially defines a third air passage.

The gas turbine engine of any preceding clause, wherein a first amplitude of the first lobed trailing edge and a second amplitude of the second lobed trailing edge are in a range of 50% to 150% of a minimum height, wherein the minimum height includes the minimum height between the centerbody and the first splitter, the minimum height between the first splitter and the second splitter, or the minimum height between the second splitter and the outer wall.

The gas turbine engine of any preceding clause, wherein the angle of at least a portion of the first splitter and the second splitter is in a range of 5 degrees to 60 degrees with respect to the mixer centerline.

The gas turbine engine of any preceding clause, wherein the first lobed trailing edge, the second lobed trailing edge, or the first lobed trailing edge and the second lobed trailing edge are lobed shaped, scalloped-lobed shaped, chevron shaped, or a combination thereof.

A fuel-air mixer comprising: an outer wall; a center body disposed radially inward of the outer wall; a first splitter disposed at least partially between the outer wall and the center body, and including a first lobed trailing edge; a second splitter disposed at least partially between the first splitter and the outer wall, and including a second lobed trailing edge axially offset from the first lobed trailing edge; a first swirler disposed at least partially between the first splitter and the second splitter; and a set of fuel orifices located at the first lobed trailing edge, the second lobed trailing edge, or the first lobed trailing edge and the second lobed trailing edge.

The fuel-air mixer of any preceding clause, wherein portions of the first lobed trailing edge and portions of the second lobed trailing edge are angled with respect to the first splitter centerline and the second splitter centerline, respectively.

The fuel-air mixer of any preceding clause, wherein angles of at least portions of the first splitter and the second splitter are in a range of 5 degrees to 60 degrees with respect to a mixer centerline.

The fuel-air mixer of any preceding clause, wherein the first lobed trailing edge has a first lobe angle, wherein the first lobe angle is in a range of −45 degrees to 45 degrees with respect to a first splitter centerline.

The fuel-air mixer of any preceding clause, wherein the second lobed trailing edge has a second lobe angle, wherein the second lobe angle is in a range of −45 degrees to 45 degrees with respect to the with respect to a second splitter centerline.

The fuel-air mixer of any preceding clause, wherein the first lobe angle is different from the second lobe angle.

The fuel-air mixer of any preceding clause, wherein a crest of the first lobed trailing edge is circumferentially offset from a crest of the second lobed trailing edge.

The fuel-air mixer of any preceding clause, wherein the first lobed trailing edge is axially downstream of the second lobed trailing edge.

The fuel-air mixer of any preceding clause, wherein the first lobed trailing edge is axially upstream of the second lobed trailing edge.

The fuel-air mixer of any preceding clause, wherein the set of fuel orifices are configured for fuel comprising hydrogen.

The fuel-air mixer of any preceding clause, wherein the fuel-air mixer further comprises a second swirler disposed at least partially between the first splitter and the center body, and a third swirler disposed at least partially between the second splitter and the outer wall.

The fuel-air mixer of any preceding clause, wherein the first swirler has a first swirl number, the second swirler has a second swirl number, and wherein the first swirl number is greater than the second swirl number.

The fuel-air mixer of any preceding clause, wherein the third swirler has a third swirl number, and wherein the second swirl number and third swirl number are lower than the first swirl number.

The fuel-air mixer of any preceding clause, wherein the center body includes an air passage.

The fuel-air mixer of any preceding clause, wherein the first lobed trailing edge has a trough and a crest, a first amplitude measured from the trough to the crest of the first lobed trailing edge, and the second lobed trailing has a trough and a crest, a second amplitude measured from the trough to the crest of the second lobed trailing edge.

The fuel-air mixer of any preceding clause, wherein an axial length of an axial offset of the first lobed trailing edge and second lobed trailing edge is measured from the first lobed trailing edge to the second lobed trailing edge and the axial length is greater than zero and less than equal to three times a maximum of a first amplitude and a second amplitude.

The fuel-air mixer of any preceding clause, wherein the axial offset of the first lobed trailing edge and second lobed trailing edge is configured to create a cascading effect to increase mixing of fuel and air.

The fuel-air mixer of any preceding clause, wherein a set of flame shaping passages are angled toward the mixer centerline.

The fuel-air mixer of any preceding clause, wherein the center body includes an air passage, wherein the air passage extends annularly about a mixer centerline.

The fuel-air mixer of any preceding clause, wherein the fuel-air mixer includes a third splitter disposed at least partially between the second splitter and the outer wall.

The fuel-air mixer of any preceding clause, wherein the third splitter at least partially defines a third air passage.

The fuel-air mixer of any preceding clause, wherein a first amplitude of the first lobed trailing edge and a second amplitude of the second lobed trailing edge are in a range of 50% to 150% of a minimum height, wherein minimum height includes the minimum height between the centerbody and the first splitter, the minimum height between the first splitter and the second splitter, or the minimum height between the second splitter and the outer wall.

The fuel-air mixer of any preceding clause, wherein the first lobed trailing edge, the second lobed trailing edge, or the first lobed trailing edge and the second lobed trailing edge are lobed shaped, scalloped-lobed shaped, chevron shaped, or a combination thereof.

What is claimed is:

1. A gas turbine engine, comprising:

a compressor section, a combustion section, and a turbine section in serial flow arrangement, with the combustion section comprising:

a combustor liner that at least partially defines a combustion chamber; and a fuel-air mixer receiving fuel comprising at least 75% by mass diatomic hydrogen, the fuel-air mixer being fluidly coupled with the combustion chamber, the fuel-air mixer comprising:

an outer wall;

a center body disposed radially inward of the outer wall;

a first splitter disposed at least partially between the outer wall and the center body, and including a first lobed trailing edge;

a second splitter disposed at least partially between the first splitter and the outer wall, and including a second lobed trailing edge axially offset from the first lobed trailing edge, wherein the first lobed trailing edge is axially downstream of the second lobed trailing edge;

a first swirler disposed at least partially between the first splitter and the second splitter; and a set of fuel orifices located at the first lobed trailing edge, the second lobed trailing edge, or the first lobed trailing edge and the second lobed trailing edge.

2. The gas turbine engine of claim 1, wherein the first lobed trailing edge and the second lobed trailing edge are angled with respect to a first splitter centerline and a second splitter centerline.

3. The gas turbine engine of claim 2, wherein an angle of at least a portion of the first splitter and the second splitter is in a range of at least 5 degrees to less than or equal to 60 degrees with respect to a mixer centerline.

4. The gas turbine engine of claim 1, wherein the first lobed trailing edge has a first lobe angle, wherein the first lobe angle is in a range of −45 degrees to 45 degrees with respect to a first splitter centerline.

5. The gas turbine engine of claim 4, wherein the second lobed trailing edge has a second lobe angle, wherein the second lobe angle is in a range of −45 degrees to 45 degrees with respect to a second splitter centerline.

6. The gas turbine engine of claim 5, wherein the first lobe angle is different from the second lobe angle.

7. The gas turbine engine of claim 1, wherein a crest of the first lobed trailing edge is circumferentially offset from a crest of the second lobed trailing edge.

8. A gas turbine engine, comprising:

a compressor section, a combustion section, and a turbine section in serial flow arrangement, with the combustion section comprising:

a combustor liner that at least partially defines a combustion chamber; and a fuel-air mixer fluidly coupled with the combustion chamber, the fuel-air mixer comprising:

an outer wall;

a center body disposed radially inward of the outer wall;

a first splitter disposed at least partially between the outer wall and the center body, and including a first lobed trailing edge;

a second splitter disposed at least partially between the first splitter and the outer wall, and including a second lobed trailing edge axially offset from the first lobed trailing edge, wherein the first lobed trailing edge is axially downstream of the second lobed trailing edge;

a first swirler disposed at least partially between the first splitter and the second splitter; and a set of fuel orifices located at the first lobed trailing edge, the second lobed trailing edge, or the first lobed trailing edge and the second lobed trailing edge.

9. The gas turbine engine of claim 8, wherein the first lobed trailing edge includes a trough and a crest, a first amplitude is measured from the trough to the crest of the first lobed trailing edge, and the second lobed trailing edge includes a trough and a crest, a second amplitude is measured from the trough to the crest of the second lobed trailing edge, wherein an axial length of an axial offset of the first lobed trailing edge and second lobed trailing edge is measured from the first lobed trailing edge to the second lobed trailing edge and the axial length is greater than zero and less than or equal to three times a maximum of a first amplitude and a second amplitude.

10. The gas turbine engine of claim 9, wherein the axial offset of the first lobed trailing edge and second lobed trailing edge is configured to create a cascading effect to increase mixing of fuel and air.

11. The gas turbine engine of claim 8, wherein the set of fuel orifices are configured for fuel comprising hydrogen.

12. The gas turbine engine of claim 8, wherein the fuel-air mixer further comprises a second swirler disposed at least partially between the first splitter and the center body, and a third swirler disposed at least partially between the second splitter and the outer wall.

13. The gas turbine engine of claim 12, wherein the first swirler has a first swirl number, the second swirler has a second swirl number, and wherein the first swirl number is greater than the second swirl number.

14. The gas turbine engine of claim 13, wherein the third swirler has a third swirl number, and wherein the second swirl number and third swirl number are lower than the first swirl number.

15. The gas turbine engine of claim 8, wherein the center body includes an air passage.

16. The gas turbine engine of claim 8, wherein the first lobed trailing edge has a trough and a crest, a first amplitude measured from the trough to the crest of the first lobed trailing edge, and the second lobed trailing edge has a second amplitude measured from a trough of the second lobed trailing edge to a crest of the second lobed trailing edge.

17. The gas turbine engine of claim 16, wherein the first amplitude and the second amplitude are in a range of 50% to 150% of a minimum height, wherein the minimum height includes the minimum height between the center body and the first splitter, the minimum height between the first splitter and the second splitter, or the minimum height between the second splitter and the outer wall.

18. The gas turbine engine of claim 8, wherein the center body includes an air passage, wherein the air passage extends annularly about a mixer centerline.

19. The gas turbine engine of claim 8, wherein the fuel-air mixer includes a third splitter disposed at least partially between the second splitter and the outer wall; and wherein the third splitter at least partially defines a third air passage.

* * * * *